United States Patent [19]

Piatt et al.

[11] Patent Number: 4,761,664

[45] Date of Patent: Aug. 2, 1988

[54] PRINT MEDIA HANDLING SYSTEM FOR COMPACT PRINTER WITH TRAVERSING, MULTIPLE PRINT HEAD CARRIAGE

[75] Inventors: Michael J. Piatt, Enon; Mark E. Brown, Kettering, both of Ohio

[73] Assignee: Eastman Kodak Company, Rochester, N.Y.

[21] Appl. No.: 20,424

[22] Filed: Mar. 2, 1987

[51] Int. Cl.[4] ..... G01D 15/24

[52] U.S. Cl. ..... 346/134; 346/136; 346/140 R; 400/624; 400/625; 355/3 SH; 355/14 SH

[58] Field of Search ..... 346/134, 136; 355/3 SH, 355/14 SH; 400/624, 625

[56] References Cited

U.S. PATENT DOCUMENTS

| | | | |
|---|---|---|---|
| 3,789,969 | 2/1974 | Howard et al. | 197/1 R |
| 4,223,323 | 9/1980 | Bader et al. | 346/140 R |
| 4,439,778 | 3/1984 | Fujisawa | 346/136 |
| 4,569,611 | 2/1986 | Watanabe et al. | 400/624 |
| 4,600,929 | 7/1986 | Cardona et al. | 346/134 |

FOREIGN PATENT DOCUMENTS

| | | | |
|---|---|---|---|
| 191222 | 8/1986 | European Pat. Off. | 346/134 |

*Primary Examiner*—E. A. Goldberg
*Assistant Examiner*—Huan H. Tran
*Attorney, Agent, or Firm*—John D. Husser

[57] ABSTRACT

Printer apparatus of the kind having: (i) print/cartridges for printing on successive line sectors of print media that are advanced into and out of the print zone; (ii) a platen means including a feed/transport periphery that is movable around an endless path past a sheet ingress zone, the print zone and a sheet egress zone; (iii) a sheet supply station for positioning a stack of sheet print media at a position upstream of the sheet ingress zone; and (iv) structure for effecting periodic feeding engagements between the platen and successive face sheets of a positioned stack, features a pressure roller, located proximate the sheet ingress zone at a position upstream of the print path, for biasing a sheet moving therepast into drive transmission relation with the platen. The printer can also comprise a downstream guide, located proximate the sheet egress zone at a position downstream of the print zone printing means. In a related feature, the printer includes a carriage constructed to support a plurality of print heads so that each can traverse the complete line width of the print zone and a control means for synchronizing movement of the carriage with the platen to effect initial sheet feed. In another related feature the printer has a reference surface precisely parallel to the longitudinal axis of the feed/transport platen and carriage structure to index upon that reference surface during traverse.

8 Claims, 3 Drawing Sheets

PRINT MEDIA HANDLING SYSTEM FOR COMPACT PRINTER WITH TRAVERSING, MULTIPLE PRINT HEAD CARRIAGE

BACKGROUND OF THE INVENTION

1. Field of the Invention

The present invention relates to serial printers having traversing print heads and more particularly to printers of this type having an integral sheet feeder and a plurality of print heads which each effect a complete line traverse across the print media printing width.

2. Background Art

U.S. application Ser. No. 20,416, entitled "Compact Printer Having an Integral Cut-Sheet Feeder" by Piatt, filed concurrently herewith discloses a highly useful structural approach for providing a "built-in" sheet feeding capability for serial output printers, e.g. of the traversing head type. These constructions enhance printer compactness by employing unique platen and sheet guide cooperations that enable both sheet feed and transport via the platen drive. In one embodiment described in that application, selective engagements, at a supply station contact zone, between a rotary platen and the top sheet of the supply stack effect feed of the sheet to a bail roller nip region that is located along the printing path. After the lead edge of a print sheet is within such nip, the feeding engagement at the supply stack region can terminate, until a next sheet feed is desired.

One implementation of the invention of U.S. application Ser. No. 20,302, entitled "High Speed Print/Cartridge Printer/Feeder" by Piatt et al, filed concurrently herewith is in a high speed printer wherein spaced print heads cooperatively print on discrete transverse segments of a line. In such an embodiment, spaced print head nests are used to advantage in effecting the requisite sheet guiding to the bail/platen nip. However, in applications wherein a plurality of print heads are each desired to traverse the complete line print width (e.g. to supply different color or density inks), additional considerations are presented in implementing the Piatt et al sheet feed approach.

SUMMARY OF INVENTION

The purpose of the present invention is to provide additional advantageous constructions for implementing the general feed/transport approach described in U.S. application Ser. No. 20,416, entitled "Compact Printer Having an Integral Cut-Sheet Feeder" by Piatt. Thus, in one aspect the present invention provides structural configurations for implementing this feed/-transport approach in a printing system wherein the print head(s) traverse the entire line width of the print zone. In another aspect the present invention provides embodiments of the above-noted feed/transport approach that are advantageous for achieving compactness in printer height. In another aspect the present invention provides improved structures for maintaining uniformity of the print head to print zone spacing for a plurality of print heads that each traverse the entire line width of the print zone.

In one embodiment the present invention constitutes in printer apparatus of the kind having: (i) means for printing on successive line sectors of print media that are advanced into and out of the print zone; (ii) platen means including a feed/transport periphery that is movable around an endless path past a sheet ingress zone, the print zone and a sheet egress zone; (iii) a sheet supply station including means for positioning a stack of sheet print media at a position upstream of the sheet ingress zone; and (iv) means for effecting periodic feeding engagements between the platen means and successive face sheets of a positioned stack, the improvement comprising upstream roller means, located proximate the sheet ingress zone at a position upstream of the path of traverse of the printing means, for biasing a sheet moving therepast into drive transmission relation with the platen means. Preferably the printer also comprises downstream guide means, located proximate the sheet egress zone at a position downstream of the path of traverse of the printing means, for biasing a sheet moving therepast toward the platen means.

In a related constitution the present invention provides carriage means constructed to support a plurality of print heads so that each can traverse the complete line width of the print zone and further includes control means for synchronizing movement of the carriage means with the platen during the initial portion of each sheet feed sequence so that (i) the carriage is moved to a central traverse position during feed of a sheet lead edge from the roller means to the downstream guide means and (ii) thereafter assumes normal line printing traverses across the print zone.

In another related aspect the printing means includes a traversing carriage having: (a) a reference surface which is mounted in a predetermined location precisely parallel to the longitudinal axis of the feed/transport platen; a carriage traverse rail generally parallel to the platen rotation axis; (b) a lower carriage portion mounted for traversing movement on the rail; (c) an upper carriage portion mounted for sliding movement on the lower carriage portion perpendicularly to the direction of carriage traverse amd including: (i) means for precisely positioning a plurality of print heads and (ii) a pair of follower members located in spaced relation opposite the reference surface and (d) spring means for urging the upper carriage portion so that the follower members contact the reference surface during traverse of the print heads.

BRIEF DESCRIPTION OF THE DRAWINGS

The subsequent description of preferred embodiments refers to the attached drawings wherein.

DETAILED DESCRIPTION OF PREFERRED EMBODIMENTS

Figure 1:
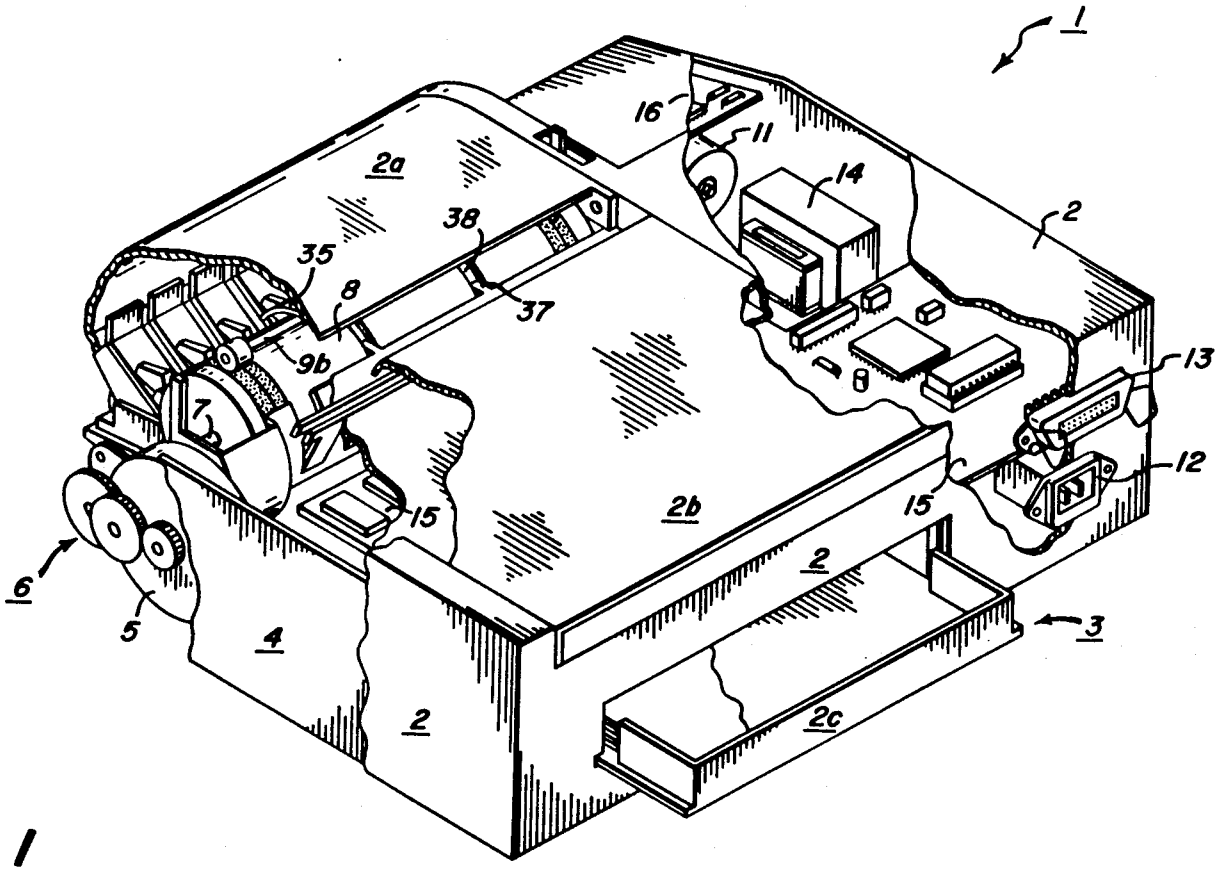
FIG. 1 is a perspective view, with portions broken away, showing one embodiment of the printer apparatus in accord with the present invention.

The printer 1 shown in FIG. 1 is an embodiment of the present invention employing ink jet printing with insertable, drop-on-demand print/cartridges. While this printing technology is particularly useful for effecting the objects of the present invention, one skilled in the art will appreciate that many of the subsequently described inventive aspects, will be useful in compact printers employing other printing approaches. The printer 1 has a housing 2, which encloses the operative printer mechanisms and electronics, and includes a pivotal front lid 2a, a pivotal rear lid 2b and a rear wall 2c of cassette drawer 3. Within the housing 2 is a main frame assembly (one wall 4 shown in FIG. 1) on which various components of the printer are mounted. Thus, a platen drive motor 5 is mounted to impart rotary drive through gear train 6 to a drive shaft 7 for a cylindrical platen 8 constructed in accord with one preferred embodiment of the invention, subsequently explained in more detail. Also mounted on the main frame assembly are an upstream bail assembly 9a (see FIG. 2) and a downstream bail assembly 9b which is constructed to cooperate with platen 8 in accord with the present invention. Also shown in FIG. 1 are the printer's carriage drive motor 11, power and data input terminals 12, 13, power transformer means 14 and logic and control circuitry, which is disposed on one or more circuit boards 15. A control panel 16 for operator interface is disposed on the top front of the print housing.

Figure 2:
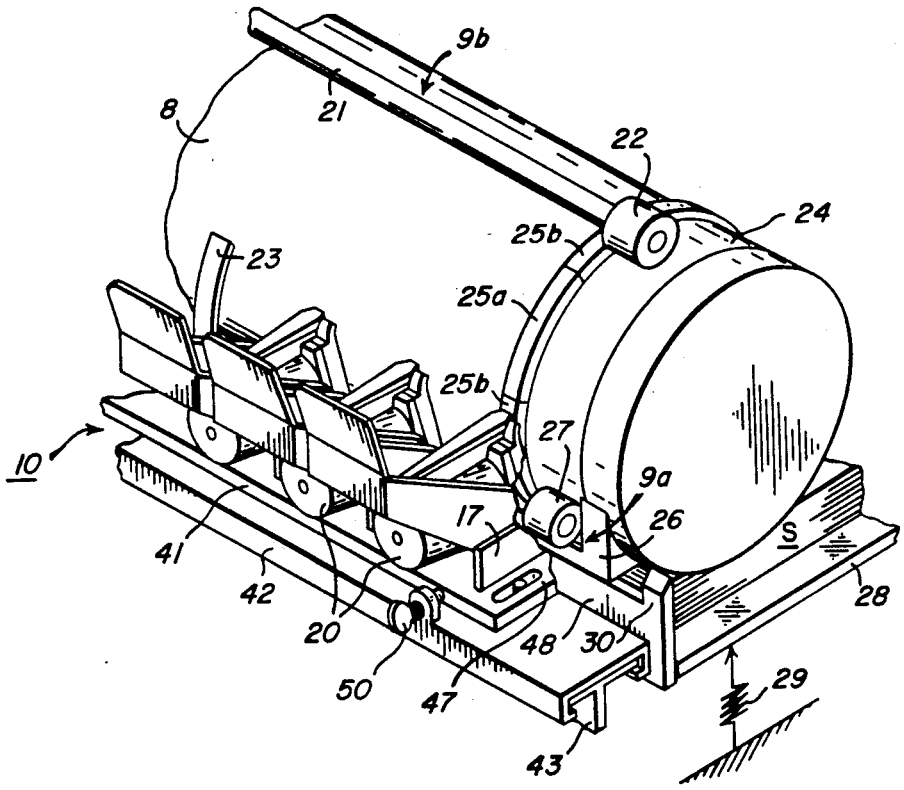
FIG. 2 is a perspective view showing a portion of the sheet feeding and transport platen of printing apparatus in its cooperation with print head carriage and guide means constructed in accordance with one embodiment of the present invention.

Referring to FIG. 2, the print/cartridge carriage 10 can be seen to comprise a plurality of nests 17 coupled for movement as a unit to translate across a linear print zone. Each of nests 17 is adapted to insertably receive, position and electrically couple a print/cartridge 20 in an operative condition within the printer. Such print/cartridges can be thermal drop-on-demand units that comprise an ink supply, a driver plate and an orifice array from which ink drops are selectively ejected toward the print zone in accord with data signals, e.g. transmitted through the printer logic from a data terminal such as a word processor unit. Both the print/cartridge construction and the positioning and coupling structures of nests 17 are described in more detail in U.S. application Ser. No. 945,134, filed Dec. 22, 1986, and entitled "Multiple Print/Cartridge Ink Jet Printer Having Accurate Vertical Interpositioning", by Piatt et al, which is incorporated herein by reference. However, other serial printing structures can be usefully employed in combination with the present invention. The carriage is traversed by a carriage drive assembly (not shown), comprising a cable and pulley loop coupled to the motor 11 and to the carriage 10.

Considering now the sheet feed constructions, the perspective illustration in FIG. 2 shows the platen and carriage structures with non-scale sizes for more clear visualization of significant features. Specifically, the platen end features have been enlarged to show one preferred embodiment that enables platen rotation to effect the feeding of sheets from a supply stack, as well as transport of a fed sheet along the print path, from an ingress through the print zone and through a printer egress. Thus, the downstream bail assembly 9b includes a shaft 21 which rotatably supports bail pressure rollers 22 near each end of the platen. Guide surfaces 23 formed on the fronts of nests 17 (see FIG. 3) curve around the lower portion of the platen periphery. Axially inwardly from the end of the platen 8, there are constructed frictional transport bands 24, e.g. formed of a rubberized coating. Each of bands 24 extends around the entire platen periphery and is of substantially the same diameter as the platen 8. The frictional transport bands are respectively aligned with pressure rollers 22 so as to pinch paper therebetween in a manner that causes transmission of the platen rotation to a print sheet which has passed into their nip. Axially inwardly from each of transport bands 24 the platen comprises raised feed ring portions 25 that extend around the platen periphery. The feed ring portions extend above the platen surface, e.g. about 0.015", and each is divided into a rough surface sector 25a and a smooth surface sector 25b. The rough sectors of the two feed rings are at corresponding peripheral locations, as are their smooth sectors.

Figure 3:
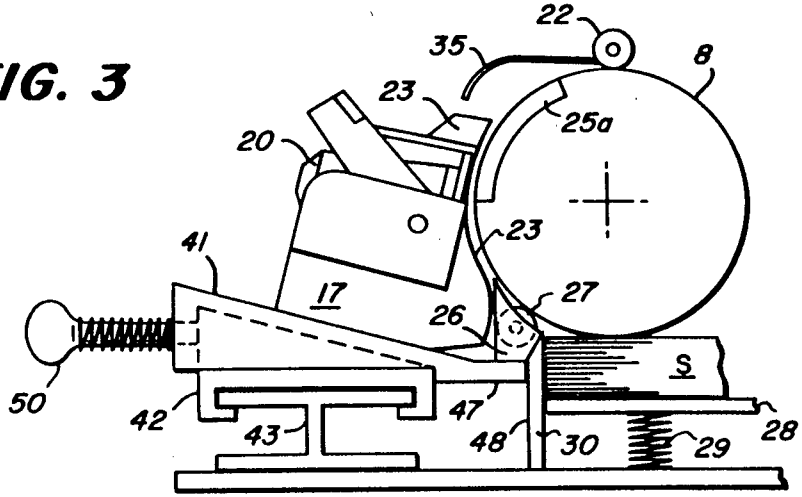
FIG. 3 is a schematic side view of the printing apparatus portions shown in FIG. 1.

As shown in FIGS. 2 and 3, lower sheet guide member 26 extends along the lower periphery of platen 8 from an ingress of the sheet feed path to a location contiguous the lower extensions of guide surfaces 23. Thus, portions 26 and 23 define means for guiding a fed sheet in close proximity to the platen 8, from the print path ingress into the nip of pressure roller 27.

Referring back to FIG. 1, it can be seen that the cassette drawer 3 is slidably mounted in the bottom of the printer for movement between a withdrawn location (for the insertion of a stack of print sheets) and a stack positioning location. As shown in FIG. 2, the front end of the stack S positioned by cassette 3 rests on a force plate 28 which is pivotally mounted at its rear end for up-down movement and is biased upwardly by spring means 29. The leading stack edge is indexed against sheet index plate 30. The functions of the structural elements described above will be further understood by considering the sheet feeding and printing sequences of the printer 1. To commence operation, the platen 8 has been initialized to a start position with the leading edge of rough surface portion 25a at the zone of initial line contact with the top sheet of stack S. (This condition can be readily achieved by various means, e.g. depression of force plate 28, while indexing the platen to the desired orientation by detection of a mark on the platen end by a photodetector not shown.) It is preferred that the contact zone A be located slightly rearwardly from the front edges of the stack to facilitate buckling separation of the top sheet when sheet feed commences.

As the platen 8 rotates counterclockwise, the rough surface portions 25a force the top stack sheet into contact with, and over, buckler elements 31, into the print path ingress. The sequential engagements at contact zone A between successive rough surface portions 25a and successive portions of the upwardly biased top sheet S drive the leading sheet edge along the print path defined by the guide means 26 so that the leading edge of the sheet will move into the nip between upstream pressure rollers 27 and transport bands 24. After the leading sheet edge has passed into the nip, the feed by rough surface portions 25a is no longer required and the smooth portions 25b can now exist at the contact zone. Feed of the print sheet continues to be provided by the rotation of the platen, now by virtue of the drive transmission at the nip of roller 22.

In the illustrated embodiment of the present invention, it is desired to direct the leading end of a fed sheet from the exit of the nip of upstream pressure rollers 27, around the platen and into the nip of downstream pressure rollers 22. This is accomplished by several cooperative features of the present invention. First, the control logic of the printer 1 contains a sheet feed control sequence whereby the carriage 10 is moved to an approximately centered position along the length of platen 8 (and is thus centered in the traverse direction across the print path). Second, the front lid portion 2a of the printer has a sheet guide 35 (see FIGS. 1 and 3) formed on its interior. This guide 35 is constructed to direct the leading end of a fed sheet that passes toward lid 2a into the nip between roller 22 and transport portion 24 of platen 8. In a preferred embodiment, the upstream rollers 27 are mounted on their shafts so as to have a higher retarding force to rotation than the downstream rollers 22 and by this construction a sheet fed into the nip of rollers 22 is tightened onto the periphery of platen 8, as sheet feed progresses. Thus, in operation a face sheet is fed by rough surface portion 25a into the nip of upstream roller 27 with its leading edge guided by lower guide 26. Smooth surface portions 25b can then exist at the stack interface region and sheet feed is effected by the drive transmission of platen 8 at the roller 27 surface 24 interface. The leading sheet edge is next guided upwardly into the printing zone by the surfaces 23 of the centered print cartridge nests.

After passing from constraint by surfaces 23, the leading sheet end contacts upper guide 35 and is eventually directed thereby into the nip between rollers 22 and surface 24, which tighten the sheet to the platen periphery, and eventually effect feed out of the trailing sheet end. After the leading sheet end has moved into the nip of downstream rollers 22, the carriage can return to its start-of-traverse position, with all print cartridges to a side of the print sheet margin point.

Considering the foregoing, it can be seen that the provision of bail rollers 27 proximate the print path egress allows a relatively short extension of rough surface portion 25a, which in turn allows a small platen diameter. In the preferred embodiment, the platen is constructed to provide four revolutions per sheet feed sequence, with dimensions selected in accord with the teachings of U.S. application Ser. No. 20,416, entitled "Compact Printer Having an Integral Cut-Sheet Feeder" by Piatt, filed concurrently herewith, which is incorporated herein by reference. The small diameter platen decreases the height dimension of printer 1.

Referring again to FIG. 2, it can be seen that the upstream bail roller assembly 9a is located below the path of traverse of the inserted print/cartridges and the downstream bail assembly 9b is located above that traverse path. By this construction the carriage 10 can traverse beyond both the right and left margin points sufficiently to allow all of the supported print cartridges to address all printing points on a print line.

In accord with another feature of the present invention, the above-described freedom for complete traverse is maintained while precisely controlling the print orifice to print media spacing across the entire print line. This is accomplished in the following manner. First, the print/cartridges 20 are accurately positioned in their nests 17, e.g. in accord with the teachings of U.S. application Ser. No. 945,134, filed Dec. 22, 1986, which is incorporated herein by reference for that purpose. Second, the nest assemblies are mounted to follow a precise path during traverse. More specifically, carriage 10 is constructed with an upper and lower carriage portions 41 and 42. Lower carriage portion 42 is mounted for traverse along rail 43 in a direction generally parallel to the linear print zone when moved by the motor driven cable pulley assembly (not shown). Upper carriage portion 41 is mounted on surface rails 46 of the lower portion 42 for movement in a direction perpendicular to the direction of traverse (i.e. toward and away from the print zone). The front edge of upper carriage portion 41 includes a pair of cam follower members 47 (one shown in FIG. 2) which follow an index cam surface 48 formed on the rear of sheet index member 30. The cam surface 48 is positioned at a predetermined spacing from the sheet feed path and precisely parallel to the axis of rotation of platen 8, with a high tolerance assembly.

Figure 4:
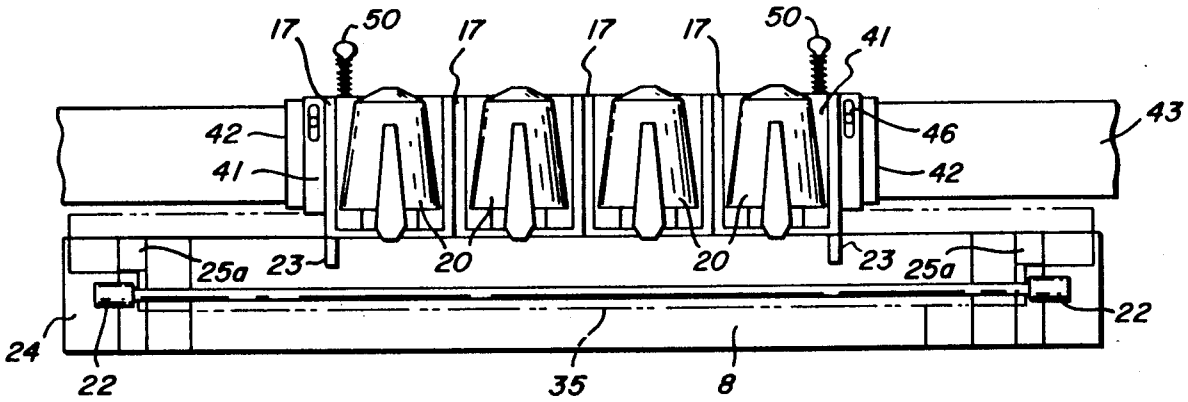
FIG. 4 is a top view of the printing apparatus portions shown in FIGS. 1 and 2.

As shown in FIGS. 2–4, spring assemblies 50 are mounted on the lower carriage portion 42 in a manner urging the upper carriage portion 41 toward the platen. Thus cam followers 47 are held against surface 48 index plate 30 throughout the carriage traverse and accordingly position the carriage nests 17 accurately vis-a-vis the print zone which is defined by the periphery of platen 8, inside the ring portions 25. Thus, the cam followers 47 allow both rotational motion and translation with respect to the guide rail 43 to maintain the orifice plates of inserted print/cartridges at proper distance from the print medium on the platen 8.

While the disclosed embodiments of the present invention describe simplified constructions and methods for control of the platen indexing and feed sequencing, more complete control systems useful with the present invention are described in concurrently filed U.S. application Ser. No. 20,425, entitled "Printer/Feeder Having Integral Control System" by Piatt et al, which is incorporated herein by reference.

The invention has been described in detail with particular reference to preferred embodiments thereof, but it will be understood that variations and modifications can be effected within the spirit and scope of the invention.

We claim:

1. Printer apparatus comprising:

(a) means, including a traversing carriage, for printing on successive line sectors of print media that are advanced into and out of a print zone;

(b) platen means including a feed/transport periphery that is movable around an endless path past a sheet ingress zone, the print zone and a sheet egress zone;

(c) a sheet supply station including means for positioning a stack of sheet print media at a position upstream of said sheet ingress zone;

(d) means for feeding successive sheets from a positioned stack;

(e) upstream roller means, located proximate said sheet ingress zone at a position upstream of the path of traverse of said printing means, for biasing a sheet moving therepast into drive transmission relation with said platen means;

(f) downstream guide means, located proximate said sheet egress zone at a position downstream of the path of traverse of said printing means, for biasing a sheet moving therepast toward said platen means; and (g) intermediate guide means formed on said carriage means for guiding a print sheet from said upstream roller means to said downstream guide means.

2. In printer apparatus of the kind having a housing, a print zone, print means for traversing said print zone and printing across sectors of print media that are successively advanced into and out of said print zone, a construction for handling discrete sheets of print media comprising:

(a) a cylindrical transport platen which is rotatable within said housing so that portions of its periphery move successively through a sheet ingress zone, said print zone and a sheet egress zone;

(b) drive means for rotating said platen;

(c) a sheet supply station formed within said housing, and including means for supporting a stack of such sheets with a face portion of the stack top opposing said transport platen at a location upstream of said ingress zone;

(d) frictional feed means located around portions of said platen and constructed to feed the top sheets of a supported stack sequentially toward said print zone;

(e) upstream roller means, located proximate said sheet ingress zone at a position upstream of the path of traverse of said printing means, for biasing a sheet moving therepast into drive transmission relation with said platen means;

(f) downstream guide means, located proximate said sheet egress zone at a position downstream of the path of traverse of said printing means, for biasing a sheet moving therepast toward said platen means; and (g) intermediate guide means, movable with said print means, for guiding a print sheet from said upstream roller means to said downstream guide means.

3. The invention defined in claim 1 wherein said downstream guide means includes roller means for urging a passing sheet into drive transmission relation with said platen means and wherein said downstream roller means has a lower rotational retarding force than said upstream roller means whereby a sheet between said roller means is moved into a taut condition on said platen means.

4. The invention defined in claim 1 wherein said carriage means is constructed to support a plurality of print heads so that each can traverse the complete line width of said print zone and further including control means for synchronizing movement of said carriage means with said platen during the initial portion of each sheet feed sequence so that (i) said carriage is moved to a central traverse position during feed of a sheet lead edge from said roller means to said downstream guide means and (ii) thereafter assumes normal line printing traverses across said print zone.

5. The invention defined in claim 1 wherein said printing means includes a traversing carriage means comprising: (a) a reference surface which is mounted in a predetermined location precisely parallel to the longitudinal axis of said platen means; a carriage traverse rail generally parallel to said platen axis; (b) a lower carriage portion mounted for traversing movement on said rail; (c) an upper carriage portion mounted for sliding movement on said lower carriage portion perpendicularly to the direction of carriage traverse and including: (i) means for precisely positioning a plurality of print heads and (ii) a pair of follower members located in spaced relation opposite said reference surface and (d) spring means for urging said upper carriage portion so that said follower members contact said reference surface during traverse of said print heads.

6. In a printer apparatus of the kind adapted to print across successive line portions of a print medium moved past a linear print zone, an improved carriage assembly for maintaining a predetermined print head-to-print zone spacing, said assembly comprising: (a) a reference surface which is mounted in a predetermined location precisely parallel to the longitudinal axis of said platen means; a carriage traverse rail generally parallel to said platen axis; (b) a lower carriage portion mounted for traversing movement on said rail; (c) an upper carriage portion mounted for sliding movement on said lower carriage portion perpendicularly to the direction of carriage traverse and including; (i) means for precisely positioning a plurality of print heads and (ii) a pair of follower members located in spaced relation opposite said reference surface and (d) spring means for urging said upper carriage portion so that said follower members contact said reference surface during traverse of said print heads.

7. The invention defined in claim 2 wherein print means comprises carriage means, constructed to support a plurality of print heads so that each can traverse the complete line width of said print zone, and further including control means for synchronizing movement of said carriage means with said platen during the initial portion of each sheet feed sequence so that (i) said carriage is moved to a central traverse position during feed of a sheet lead edge from said roller means to said downstream guide means and (ii) thereafter assumes normal line printing traverses across said print zone.

8. The invention defined in claim 2 wherein said printing means includes a traversing carriage means comprising: (a) a reference surface which is mounted in a predetermined location precisely parallel to the longitudinal axis of said platen means; a carriage traverse rail generally parallel to said platen axis; (b) a lower carriage portion mounted for traversing movement on said rail; (c) an upper carriage portion mounted for sliding movement on said lower carriage portion perpendicularly to the direction of carriage traverse and including: (i) means for precisely positioning a plurality of print heads and (ii) a pair of follower members located in spaced relation opposite said reference surface and (d) spring means for urging said upper carriage portion so that said follower members contact said reference surface during traverse of said print heads.

* * * * *